United States Patent [19]

Mohr

[11] 3,936,678

[45] Feb. 3, 1976

[54] MAGNETICALLY LATCHED PIEZOELECTRIC STRIKING IGNITER

[75] Inventor: Walter Mohr, Frankfurt am Main, Germany

[73] Assignee: Braun Aktiengesellschaft, Frankfurt am Main, Germany

[22] Filed: Aug. 12, 1974

[21] Appl. No.: 496,588

[30] Foreign Application Priority Data

Aug. 8, 1973 Germany ..... 2341544
Aug. 17, 1973 Germany ..... 2341714

[52] U.S. Cl. ..... 310/8.7; 310/8.3; 310/9.1; 317/DIG. 11

[51] Int. Cl.[2] ..... H01L 41/04

[58] Field of Search ..... 310/8.3–8.7, 310/9.1, 9.4, 15; 317/DIG. 11

[56] References Cited

UNITED STATES PATENTS

| | | | |
|---|---|---|---|
| 3,408,153 | 10/1968 | Ishiguro | 310/8.7 X |
| 3,540,823 | 11/1970 | Ebine et al. | 310/8.7 X |
| 3,586,888 | 6/1971 | Dorfman | 310/8.3 |
| 3,693,033 | 9/1972 | Troesh | 310/15 X |
| 3,718,828 | 2/1973 | Britton | 310/15 |

*Primary Examiner*—Mark O. Budd
*Attorney, Agent, or Firm*—Frederick E. Bartholy

[57] ABSTRACT

A piezoelectric igniter, especially for lighters, with a striking mechanism comprising a hammer which is movable towards a piezoelectric transducer and which co-operates with an energy storing spring which can be compressed by an actuating member. The striking mechanism has a release means comprising a permanent magnet co-operating with the hammer such that the hammer is held in its rest position by the attractive magnetic forces of the permanent magnet and is released if the energy storing spring has been compressed by the actuating member to such an extent that the spring force exceeds the attractive force of the permanent magnet. The hammer is accelerated by the energy storing spring towards the piezoelectric transducer and impinges on said transducer to generate an electric pulse which is led to a spark gap arranged adjacent a gas discharge valve of the igniter.

8 Claims, 7 Drawing Figures

MAGNETICALLY LATCHED PIEZOELECTRIC STRIKING IGNITER

The invention relates to a piezoelectric igniter with a striking mechanism, more especially for lighters, having a piezoelectric transducer, a hammer which is movable in the direction of the latter and which co-operates with an energy storing spring which can be compressed by an actuating member, having a movement release device for the hammer, and having a housing which surrounds these parts and against the one front end of which the piezoelectric transducer butts.

It is an object of the invention to improve the aforementioned igniter in such a way that it can be constructed in a more compact manner than piezoelectric striking igniters with a comparable spark energy.

The solution to this problem is to be seen in the fact that the movement release device forms a magnetic retaining circuit and that the energy storing spring is biased.

According to a special embodiment, the magnetic retaining circuit comprises a permanent magnet with laterally mounted pole plates, which is fixed in the housing and which is magnetized transversely to the direction of movement of

BACKGROUND OF THE INVENTION

A piezoelectric igniter for lighters is already known, having a striking mechanism and a piezoelectric transducer and a hammer which is movable in the direction of the latter and which co-operates with an energy storing spring which can be compressed by an actuating member. Said igniter further comprises a movement release device for the hammer and a housing which surrounds these parts and against the one front end of which the piezoelectric transducer butts.

OBJECTS OF THE INVENTION

It is an object of the invention to improve the aforementioned igniter in such a way that it can be constructed more compact.

It is another object of the invention to provide an igniter which may be manufactured at relatively low costs and which affords a smaller permanent magnet.

The igniter according to the invention comprises a movement release device forming a magnet retaining circuit and an energy storing spring that is biased in its rest position.

According to a special embodiment, the magnetic retaining circuit comprises a permanent magnet with laterally mounted pole plates, which is fixed in the housing and which is magnetized transversely to the direction of movement of the hammer and which has a free axial passage, the hammer having a lug which projects into the free passage, and the energy storing spring acting on this lug as well as on an actuating cap which serves as an actuating member.

A further embodiment is to be seen in that the magnetic retaining circuit comprises a permanent magnet with laterally mounted pole plates, which is fixed in the housing and which is magnetized transversely to the direction of movement of the hammer, that the energy storing spring butts against the hammer, on the one hand, and against an actuating cap, which serves as an actuating member, on the other hand.

Preferably, the energy storing spring butts against a shoulder of the hammer.

In addition, a stop, which is fastened to the hammer, can be provided between the energy storing spring and the actuating cap, the actuating cap comprising slots for receiving said stops, so that these are slideably movable in the slots.

Another further development of the second embodiment consists in that the energy storing spring is surrounded by a casing which is fastened to the underside of the actuating cap and which surrounds the side surface of the hammer with play and which comprises a flange which is directed radially inwards and on which the bottom of the hammer rests freely. The casing serves, at the same time, for biasing the energy storing spring and for lifting the hammer into its position of rest, whenever the piezoelectric striking igniter has been operated.

A preferred embodiment comprises a permanent magnet having two plane surfaces and which is magnetized transversely to said plane surfaces, wherein a ferromagnetic pole plate is adjoining each of said plane surfaces, said pole plates being fastened by at least one rivet pin made of a ferromagnetic material and extending from the first pole plate to the second pole plate. Such a magnet unit may be manufactured in an easy and simple manner and has a magnetic shunt resistance, which is provided by said rivet pin and which avoids a demagnetization of a permanent magnet by the repeated contact-breaking of the hammer in operation of the igniter.

Preferably, the pole plate and the rivet pin or rivet pins are manufcatured from sintered iron and consist, in particular, of one piece.

According to a further development, the pole plates are arched cylindrically on their sides which are averted from the permanent magnet.

According to another embodiment, the rivet pins are sintered onto the associated pole plate.

Another embodiment is distinguished in that the magnetic retaining circuit comprises a permanent magnet with laterally mounted pole plates, which is fixed in the housing and which is magnetized transversely to the direction of movement of the hammer and which has a free axial passage, that the energy storing spring is disposed in a blind hole in the hammer, which blind hole is in alignment with the axial passage, and is biased by a holding member which is fastened to the hammer, and that the actuating member comprises a shank which extends into the axial passage and which is provided with a slot at the level of the holding member.

A further embodiment is distinguished in that the magnetic retaining circuit is formed by a cup-shaped iron short-circuit part with a permanent magnet situated therein, both of which form the hammer, and by a yoke plate which is fixed in the housing, that the yoke plate is provided with a central bore, that the hammer comprises a central shank which points upwards and which extends through the bore and which is connected, at its free end, to a disc which is disposed in a diametral plane, and that the energy storing spring is disposed between the actuating cap, which serves as an actuating member, and the disc. Such a construction leads to a tilt-free guidance of the hammer in the housing.

BRIEF DESCRIPTION OF THE DRAWINGS

Hereinafter, the invention is further described in several exemplified embodiments with reference to diagrammatic drawings.

DETAILED DESCRIPTION OF PREFERRED EMBODIMENTS

Figure 1:
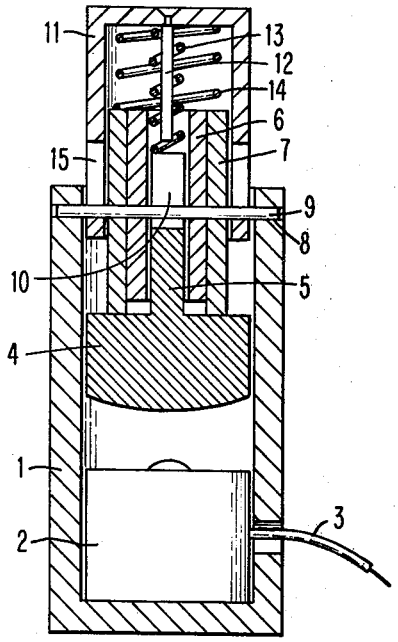
FIG. 1 is an axial section through a piezoelectric striking igniter according to the invention.

The piezoelectric striking igniter shown in FIG. 1 comprises a cylindrical housing 1, open at one side face, and in which there is inserted a piezoelectric transducer 2, whose high-tension connection 3 is guided to the outside through the housing.

Disposed above the piezoelectric transducer there is a hammer 4 which has a central shank 5 which is provided, at its free end, with a slot 10, which surrounds a holding pin 9, which is driven through bores 8 in the housing 1.

Seated at this holding pin 9 there is a permanent magnet arrangement with a permanent magnet 6, comrising a central passage, and with pole plates 7 which are mounted laterally on opposite sides of the magnet. In the lower region, the pole plates 7 project to some extent beyond the front surface of the permanent magnet and form, together with the hammer 4 which is made of a ferromagnetic material, a magnetic circuit which tends to keep the hammer 4 in abutment against the pole plates 7 with a specific force.

The part of the permanent magnet arrangement which is directed towards the outside is surrounded by an actuating cap 11, which is, in the vicinity of its free end, provided with two diametrically opposite longitudinal holes 15, through which the holding pin 9 extends and which limit the stroke of the actuating cap 11.

Fastened in the centre of the front plate of the actuating cap 11 there is a guide pin 12, around which an energy storing spring 13 is placed which acts, with its one end, on the front side of the actuating cap 11 and, with its other end, on the central shank 5. The guide pin 12 serves for avoiding a lateral deflection of the energy storing spring, when the piezoelectric striking igniter is operated.

A return spring 14, which serves for biasing the actuating cap 11 into its position of rest, is furthermore disposed between the front side of the actuating cap 11 and the permanent magnet arrangement 6, 7.

The piezoelectric striking igniter shown in FIG. 1 has the following mode of operation. When the actuating cap 11 is pressed down, the energy storing spring 13 as well as the return spring 14 are compressed at the same time. Thus, the energy storing spring exerts an increasing pressure on the central shank 5 of the hammer 4. At the point in time when the force of the pressure extered by the energy storing spring becomes greater than the retaining force of the permanent magnet arrangement, the hammer 4 detaches itself from the pole plates 7 and is accelerated by the force of the energy storing spring 13 and is impelled against the piezoelectric transducer which produces, upon the impingement of the hammer 4, a high-tension pulse which can be received by the high-tension connection 3.

When the actuating cap 11 is released again, then the return spring 14 lifts the actuating cap into its position of rest, shown in FIG. 1. The hammer 4 is retracted by the lines of flux emanating from the permanent magnet arrangement. The housing 1 and the actuating cap 11 may be manufactured from a non-magnetic material, for instance plastics material.

Figure 2:
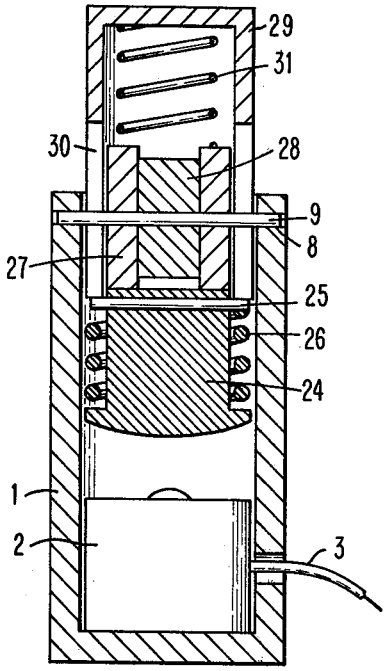
FIG. 2 is an axial section through a modified embodiment of a piezoelectric striking igniter.

FIG. 2 shows a modified embodiment in relation to FIG. 1, which comprises a housing 1, a piezoelectric transducer 2, a high-tension connection 3, a bore 8 through the housing and a holding pin 9 which is placed through it, as in the embodiment according to FIG. 1.

The permanent magnet arrangement consists of a parallelepiped-shaped permanent magnet 28, at the lateral surface of which there are attached pole plates 27 which project, on both front sides, beyond the permanent magnet 28. Butting against the underside of the pole plates 27 there is a hammer 24 which is made of a ferromagnetic material and which is, at its circumferential surface, provided with a recess which extends to the upper front side region and which receives an energy storing spring 26. Said spring rests, with its lower end, on the shoulder of the recess and is, at its upper end, biased by a holding pin 25, which extends through a bore of the hammer.

Surmounting the permanent magnet arrangement is an actuating cap 29, which is provided with longitudinal slots 30 which extend to the open end of the actuating cap. Extending through these longitudinal slots is the holding pin 9 as well as, in the lower region, the holding pin 25.

In this embodiment, no special devices are provided to prevent the actuating cap 29 from falling out. This is rather brought about by the incorporation of the piezoelectric striking igniter in a lighter or the like.

The mode of operation is as follows. When the actuating cap 29 is pressed down, the lower front edge thereof compresses the energy storing spring 26, and the holding pin 25 passes along the longitudinal slots 30. As soon as the force produced by the energy storing spring 26 exceeds the retaining force of the permanent magnet arrangement 27, 28, the hammer 24 detaches itself from the pole plates 27 and is impelled against the piezoelectric transducer 2 and generates upon its impact a high-tension pulse on the high-tension connection 3. When the actuating cap 29 is released, the return spring 31 presses the latter into its position of rest, and the hammer 24 is retracted by the lines of the stray field of the permanent magnet arrangement 27, 28. However, it is also possible to provide a separate return spring for the hammer.

Figure 3:
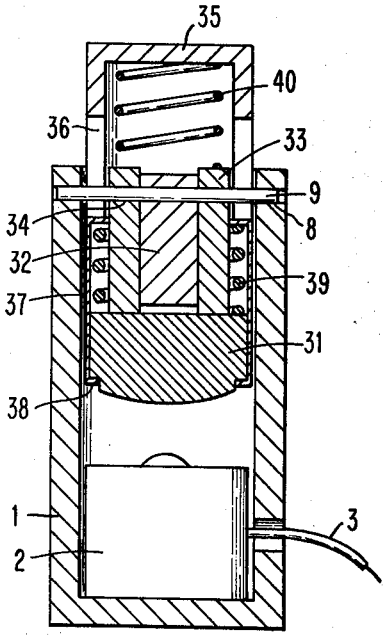
FIG. 3 is an axial section through a further embodiment of a piezoelectric striking igniter.

FIG. 3 shows a somewhat modified embodiment in relation to FIG. 2, in which the permanent magnet arrangement comprises a parallelepiped-shaped permanent magnet 32 and pole plates 33 adjoining the same on both sides. Said permanent magnet arrangement is provided in its upper region with a transversal bore 34, through which the holding pin 9 is placed.

The actuating cap 35 is provided with diametrically opposite longitudinal slots 36, but it is somewhat shorter in design than the actuating cap 29 according to FIG. 2.

In the interior of the actuating cap 35 there is a return spring 40 which rests, with its lower end, on the pole plates 33.

Fastened to the lower front edge of the actuating cap 35 is a casing 37 which is, at its two front ends, provided with flanges 38 which are directed radially inwards.

A hammer 31, made of a ferromagnetic material, rests on the lower flange 38 and is disposed displaceably in the in the lower region of the casing. An energy storing spring 39 is inserted under bias between the upper side of the hammer 31 and the upper flange of the jacket 37.

The piezoelectric striking igniter according to FIG. 3 has the following mode of operation. When the actuating cap 35 is pressed down, the casing 37 also moves downwards, so that the lower flange 38 becomes detached from the hammer 31 and the energy storing spring 39 is compressed at the same time. As soon as the pressure by the energy storing spring 39 exceeds the retaining force of the permanent magnet arrangement 32, 33, the hammer 31 detaches itself from the pole plates 33 and is accelerated by the force of the energy storing spring 39 and moves downwards until it impinges on the piezoelectric transducer 2 and generates a high-tension pulse in the latter.

Of course, the lower flange 38 must have come down to such an extent that it does not impede the movement of the hammer 31. This can, for example, be achieved by a dimensioning of the bias and the spring constant of the energy storing spring 39 such that the retaining force of the magnet is not overcome unless the individual coils of the energy storing spring 39 touch one another.

Figure 4:
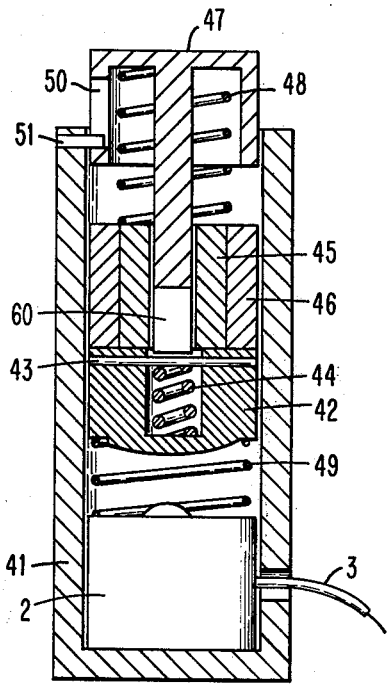
FIG. 4 is an axial section through a fourth embodiment of a piezoelectric striking igniter.

FIG. 4 shows a further embodiment of a piezoelectric striking igniter according to the invention. In the housing 41, a piezoelectric transducer 2 rests on the bottom. Above said transducer there is a hammer 42, which is made of a ferromagnetic material and which is provided with a central blind bore, in which an energy storing spring 44 is disposed. The latter is kept under bias by means of a pin 43, which is driven through a diametral bore of the hammer 42. A return spring 49 extends between the underside of the hammer 42 and the piezoelectric transducer 2.

The permanent magnet arrangement comprises a permanent magnet 44, which is provided with a central bore and to the outer side surfaces of which there are attached pole plates 46, the outer contour of which is adapted to the interior of the housing 41. The permanent magnet arrangement 45, 46 is situated above the hammer 42 and is glued into the housing 41.

The actuating cap 47 is mushroom-shaped in design, and the central shank thereof projects into the central passage of the permanent magnet arrangement 45, 46 and is provided with a slot 60 which can engage over the pin 43.

The surface region of the mushroom-shaped actuating cap 7 is provided with a longitudinal hole 50, which does not extend to the level of the front edge and into which a pin 51 projects, which is driven through the housing 41 and which limits the stroke of the actuating cap 47.

The shank of the actuating cap 47 is surrounded by a return spring 48, which rests on the front side of the actuating cap as well as on the permanent magnet arrangement 45, 46.

The piezoelectric striking igniter according to FIG. 4 has the following mode of operation. When the actuating cap 47 is pressed down, the slot 60 passes over the pin 43 and compresses the energy storing spring 44. As soon as the force of the pressure exerted by the energy storing spring 44 exceeds the retaining force of the permanent magnet arrangement 45, 46, the hammer 42 detaches itself from the permanent magnet arrangement and is impelled in the direction of the piezoelectric transducer 2, during which movement the return spring 49 is compressed. When the hammer impinges on the piezoelectric transducer 2, a high-tension pulse is generated in the latter.

When the actuating cap is released, first the energy storing spring 44 relaxes until it butts against the pin 43, causing the hammer 42 to lift off from the piezoelectric transducer 2 under the influence of the return spring 49, and to return into its position of rest. The return spring 48 lifts the actuating cap 47 into its position of rest. However, return spring 48 may be omitted, since the free front end of the shank of the actuating cap 47 is lifted by the energy storing spring 44.

Alternatively, the return spring 49 may be omitted, if provision is made that the hammer 42 is attracted to a sufficient extent by the lines of the stray field of the permanent magnet arrangement 45, 46. In this case, the return spring 48 serves for lifting the actuating cap 47.

Figure 5:
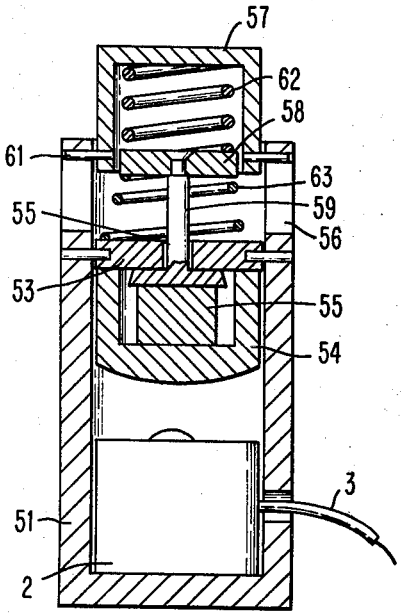
FIG. 5 is an axial section through a fifth embodiment of a piezoelectric striking igniter.

FIG. 5 shows an embodiment in which the hammer consists of a cup-shaped iron short-circuit part 54 and a permanent magnet 55, which is situated therein. The permanent magnet 55 is, in contrast with the embodiments described in the aforegoing, magnetized in the axial direction.

The cup-shaped iron short-circuit part 54 butts, in its state of rest, against a yoke plate 53 which is made of a ferromagnetic material and which is tightly pinned to the housing 51 and which lies in a diametral plane. Said yoke plate comprises a central bore 55.

Glued onto the free front end of the permanent magnet 55 is a pole piece 59, which is T-shaped in cross-section and the shank of which extends through the central bore 55 of the yoke plate 53 and which is riveted, at its free end, to a disc 58.

The housing 51 is provided with diametrically opposite longitudinal holes 56, into which there engage guide pins 61 which are pinned to an actuating cap 57.

An energy storing spring 62 is inserted under bias between the front side of the actuating cap and the disc 58.

Moreover, there is provided a return spring 63 which butts against the underside of the disc 58 as well as against the upper side of the yoke plate 53. This return spring 63 may be designed as a conical coil spring, so that its thickness in the compressed state is a minimum.

The piezoelectric striking igniter according to FIG. 5 has the following mode of operation. When the actuating cap 57 is pressed down, the energy storing spring 62 is compressed until the same produces a force which is greater than the retaining force of the magnetic retaining circuit formed by the parts 53, 54, 55. When the retaining force has been exceeded, the hammer 54, 55 moves downwards against the piezoelectric transducer 2 and generates a high-tension pulse therein. During this movement, the return spring 63 is compressed to a flat coil.

When the actuating cap 57 is released, at first the energy storing spring 62 slackens and then the cup-shaped hammer 54, 55, with the parts fastened thereto, is lifted again by the return spring 63.

In several embodiments described in the aforegoing, it is necessary that specific parts of the movable parts cannot become twisted in the housing. This may be achieved, by way of example, in that the housing and the respective parts have a cross-sectional form that differs from the circular form, for instance, that they are square-shaped.

In any case, the energy storing spring 62 is biased in its state of rest. By this means, a shorter structural length of the piezoelectric striking igniter, compared with known constructions, can be achieved.

Figure 6:
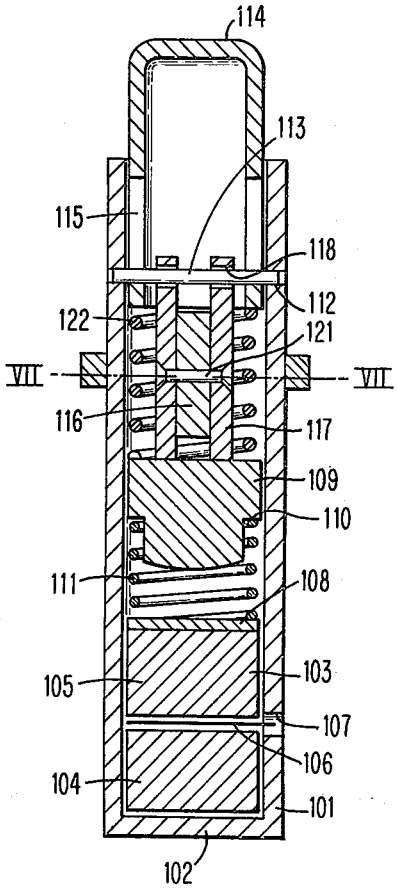
FIG. 6 is a longitudinal section through a piezoelectric igniter with a magnet unit according to the invention.

The piezoelectric striking igniter shown in FIG. 6 comprises a cylindrical housing 101 made of a plastics material. The housing has the shape of a circular cross-section and is closed at one end by a bottom 102. The interior of the housing likewise has a circular cross-section. Resting on the bottom of the housing there is a piezoelectric transducer 103 which consists of two piezoelectric barium titanate crystals 104 and 105, which are arranged one behind the other and between which there is disposed an electrode 106 which is guided towards the outside through an aperture 107 in the housing wall. A bounce plate 108 made of metal is disposed on top of the piezoelectric barium titanate body 105 and may be bonded to the barium titanate body.

The piezoelectric striking igniter comprises furthermore a hammer 109 which is provided, at the surface region pointing towards the bounce plate 108, with a circumferential recess which ends at a shoulder 110. Disposed between the bounce plate 108 and the shoulder 110 there is a return spring 111, which is ground in plane parallel manner on its opposite end faces.

At the open top end of the housing 101 there are diametrically opposite bores 112, through which a holding pin 113 is driven, which serves for holding an actuating cap 114 and a magnet unit, which will be described below.

The actuating cap 114 is cup-shaped in design and comprises two diametrically opposite paraxially extending longitudinal holes 115, through which the holding pin 113 is placed. The longitudinal holes allow a movability of the actuating cap 114 that corresponds to its length. Said actuating cap has an external diameter which is somewhat smaller than the internal diameter of the housing 101, so that the actuating cap cannot be substantially tilted.

The magnet unit comprises a parallelepiped-shaped magnet 116, at the two opposite longitudinal sides of which there are fitted pole plates 117 which project, on both sides, somewhat beyond the length of the permanent magnet 116.

The ends of the pole plates 117 which project at the top are provided with bores 118, through which the holding pin 113 is placed. In this way, the magnet unit is fixedly held in the housing.

Figure 7:
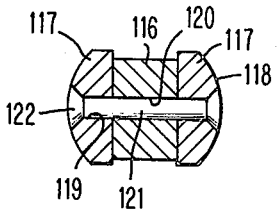
FIG. 7 is a cross-section through the magnet unit along the line II—II of FIG. 6.

FIG. 7 shows a cross-section through the magnet unit. The pole plates 117 are identical in design and are shaped as a circular cylinder jacket at their surface 118 which points away from the permanent magnet 116. Each of the pole plates 117 is provided with a bore 119, which is conically widened in the region of the arched surfaces 118.

The permanent magnet 116 is provided with a bore 120, which has a diameter corresponding to that of the bore 119 in the pole plates. The pole plates and the permanent magnet are held together by a rivet 121, which is introduced through the left-hand pole plate (in FIG. 7), through the aperture 119, until it butts with its head 122 against the conical widening of the aperture 119. The end of the rivet 121 which projects beyond the pole plate 117 to the right is clinched in the usual way, whereby the parts of the magnet unit are tightly connected to one another.

The rivet 121 consists of a ferromagnetic material. The pole plates 117 and the rivet 121 may also be made of sintered iron, and the rivet 121 may be sintered into one of the pole plates or it may alternatively be manufactured integrally with the latter, thus avoiding to provide an aperture 119 in the respective pole plate.

The lower ends of the pole plates 117 butt against a front surface of the hammer 109, which consists of a ferromagnetic material and therefore is retained by the magnetic flux of the permanent magnet.

The piezoelectric igniter furthermore comrises an energy storing spring 122 which acts on the front surface of the hammer 109, on the one hand, and on the front edge of the open end of the actuating cap 114, on the other hand. The ends of the energy storing spring 122 may be ground in plane parallel manner, in order to ensure that the hammer 109 is not tilted during its downward movement.

The piezoelectric striking igniter has the following mode of operation. In the state of rest (FIG. 6), the energy storing spring 122 is practically in its relaxed state and does not exert any substantial force on the hammer 109. If the actuating cap 114 is now pressed downwards, the energy storing spring 119 is compressed and, accordingly, an increasing force is exerted on the hammer 109. As soon as the compressive force of the energy storing spring 122 exceeds the retaining force of the magnet unit, the hammer 109 detaches itself from the same and is impelled downwards against the bounce plate 108. The return spring 111 already exerts a slight pressure on the piezoelectric transducer, before the hammer 109 impinges on the bounce plate. In any case, the individual parts of the piezoelectric transducer are compressed by this pressure of the return spring to such an extent that they no longer rest against one another loosely or with play. By the compression of the piezoelectric transducer before the impact of the hammer it is achieved that the piezoelectric transducer generates a maximum electric energy at a given impact of the hammer.

The circumferential recess at the surface of the hammer 109 allows a reception of the return spring 111 in the compressed state thereof, i.e. when the hammer 109 rests on the bounce plate 108.

In the state of rest of the piezoelectric striking igniter, part of the magnetic flux of the permanent magnet 116 passes through the hammer 109, whilst another part passes through the rivet 121. Because of the small cross-sectional area of the rivet 121 in comparison with the cross-sectional area of the pole plates 117 and the hammer 109, the greatest part of the magnetic flux passes through the hammer, so that the retaining force of the magnet unit is not weakened by the rivet 121 to an appreciable extent.

When the hammer 109 breaks away from the pole plates 117, the magnetic resistance increases considerably at this point, so that the rivet 121 absorbs a substantial part of the magnetic flux. By this means it is ensured that the permanent magnet is not substantially demagnetized in the course of time. Therefore, less expensive magnets may be used without any disadvantage.

I claim:

1. A piezoelectric igniter with a striking mechanism, more especially for lighters, having a piezoelectric transducer, a hammer which is movable in the direction of the latter and which co-operates with an energy storing spring which can be compressed by an actuating member, having a movement release device for the hammer and having a housing which surrounds these parts and against the one front end of which the piezoelectric transducer butts, wherein the movement release device forms a magnetic holding circuit comprising a permanent magnet (45) with laterally mounted pole plates (46), which is fixed in the housing and which is magnetized transversely to the direction of movement of the hammer (42) and which has a free axial passage, the energy storing spring (44) lies in a blind hold in the hammer (42), which blind hole is in alignment with the axial passage and is biased by a holding member (43) which is fastened to the hammer, and wherein the actuating member (47) comprises a shank which extends into the axial passage and which is provided with a slot (60) at the points of the holding member.

2. A piezoelectric igniter as claimed in claim 1, wherein the energy storing spring (39) is surrounded by a casing (37) which is fastened to the underside of the actuating cap (35) and which surrounds the lateral surface of the hammer (31) with play and which comprises a flange (38), which is directed radially inwards and on which the bottom of the hammer (31) rests freely.

3. A piezoelectric igniter as claimed in claim 1, wherein the magnetic holding circuit comprises a cup-shaped iron short-circuit part (54) with a permanent magnet (55) situated therein, both of which form the hammer, and a yoke plate (53) which is fixed in the housing, and wherein the yoke plate (53) is provided with a central bore (65), the hammer (54, 55) comprises a central shank (59) which points upwards and which extends through the bore (65) and which is, at its free end, connected to a disc (58), which lies in a diametral plane, and the energy storing spring (62) is disposed between the actuating cap (57), which serves as an actuating member, and the disc (58).

4. A piezoelectric igniter as claimed in claim 1, wherein a cone-shaped return spring is arranged between the disc (58) and the yoke plate (53).

5. A piezoelectric igniter as claimed in claim 1, wherein the magnetic holding device comprises a permanent magnet (116) having two plane surfaces and which is magnetized transversely to said plane surfaces, a ferromagnetic pole plate (117) adjoining each of the plane surfaces, respectively, at least one rivet pin (121) made of a ferromagnetic material and butting against one of the pole plates, and an aperture (119) provided in the other pole plate for receiving the rivet pin.

6. A piezoelectric igniter as claimed in claim 1, wherein the rivet pin is attached, preferably sintered, to the respective pole plate.

7. A piezoelectric igniter as claimed in claim 1, wherein one of the pole plates is integral with the rivet pin.

8. A piezoelectric igniter as claimed in claim 1, wherein the pole plates (117) are arched in a cylindrical manner at their sides (118) which are averted from the permanent magnet (116).

* * * * *